US008372568B2

(12) United States Patent
Yu et al.

(10) Patent No.: US 8,372,568 B2
(45) Date of Patent: Feb. 12, 2013

(54) GELATIN RELEASE LAYER AND METHODS FOR USING THE SAME

(75) Inventors: Robert C. U. Yu, Webster, NY (US); Kent J. Evans, Lima, NY (US); Yuhua Tong, Webster, NY (US); Nancy L. Belknap, Rochester, NY (US); Helen R. Cherniack, Rochester, NY (US); Robert P. Altavela, Webster, NY (US); Edward F. Grabowski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 506 days.

(21) Appl. No.: 12/613,461

(22) Filed: Nov. 5, 2009

(65) Prior Publication Data

US 2011/0104602 A1 May 5, 2011

(51) Int. Cl.
*G03G 15/04* (2006.01)

(52) U.S. Cl. ..... 430/60; 430/66; 430/56; 430/76; 134/2

(58) Field of Classification Search ..... 430/56, 430/76, 130; 134/2
See application file for complete search history.

(56) References Cited

U.S. PATENT DOCUMENTS

| | | | | |
|---|---|---|---|---|
| 3,121,006 | A | 2/1964 | Middleton et al. | |
| 4,286,033 | A | 8/1981 | Neyhart et al. | |
| 4,291,110 | A | 9/1981 | Lee | |
| 4,338,387 | A | 7/1982 | Hewitt | |
| 4,464,450 | A | 8/1984 | Teuscher | |
| 4,518,669 | A | 5/1985 | Yashiki | |
| 4,579,801 | A | 4/1986 | Yashiki | |
| 4,587,189 | A | 5/1986 | Hor et al. | |
| 4,775,605 | A | 10/1988 | Seki et al. | |
| 4,921,773 | A | 5/1990 | Melnyk et al. | |
| 5,017,449 | A | 5/1991 | Yoshihara | |
| 5,153,094 | A | 10/1992 | Kazmaier et al. | |
| 5,166,339 | A | 11/1992 | Duff et al. | |
| 5,189,155 | A | 2/1993 | Mayo et al. | |
| 5,189,156 | A | 2/1993 | Mayo et al. | |
| 5,344,734 | A | 9/1994 | Monbaliu et al. | |
| 5,489,496 | A | 2/1996 | Katayama et al. | |
| 5,641,599 | A | 6/1997 | Markovics et al. | |
| 5,656,407 | A | 8/1997 | Kawahara | |
| 5,721,080 | A | 2/1998 | Terrell et al. | |
| 5,756,245 | A | 5/1998 | Esteghamatian et al. | |
| 5,916,724 | A * | 6/1999 | Sekine et al. | 430/133 |
| 6,180,309 | B1 | 1/2001 | Maty et al. | |
| 6,200,716 | B1 | 3/2001 | Fuller et al. | |
| 6,207,334 | B1 | 3/2001 | Dinh et al. | |
| 2002/0081539 | A1 * | 6/2002 | Ito et al. | 430/523 |

* cited by examiner

*Primary Examiner* — Thorl Chea
(74) *Attorney, Agent, or Firm* — Pillsbury Winthrop Shaw Pittman LLP

(57) ABSTRACT

The disclosed embodiments are directed to a method for removing photoreceptor coatings from a rigid substrate, wherein the photoreceptor coatings disposed over a substrate of an electrophotographic photoreceptor, in order to recover it for re-use in photoreceptor manufacturing. More specifically, the invention discloses a photoreceptor substrate recovery methodology that includes the creation of an inner release layer over the substrate and followed by subjecting the rejected or used electrophotographic photoreceptor to a step of soaking in a non-toxic and environmentally-friendly stripping solution that separates the coatings from the substrate.

20 Claims, 2 Drawing Sheets

GELATIN RELEASE LAYER AND METHODS FOR USING THE SAME

CROSS REFERENCE TO RELATED APPLICATIONS

Reference is made to co-pending, U.S. patent application Ser. No. 12/613,426 filed on Nov. 5, 2009 to Belknap et al., entitled, "A Silane Release Layer and Methods for Using the Same", the entire disclosures of which are incorporated herein by reference in their entirety.

BACKGROUND

This disclosure relates generally to methods for removing photoreceptor coatings from a substrate, wherein the photoreceptor coatings disposed over a substrate of an electrophotographic photoreceptor. More specifically, described herein are a photoreceptor coatings removal method which is based on an electrophotographic photoreceptor comprising a gelatin release layer between the photoreceptor substrate and one or more coating layers. The present embodiments provide a simple yet efficient method to reclaim and recycle the substrates for use in remanufacturing electrophotographic photoreceptors.

In electrophotography, the substrate for photoreceptors in a rigid drum format is required to be manufactured with high dimensional accuracy in terms of straightness and roundness, optimum surface reflectance and roughness, and desired thickness. In order to obtain such a dimensional accuracy, the substrate surface is polished at a high accuracy by using sand blustering, glass bean honing, or a diamond tool and/or the like. Once the substrate surface is formed, at least one coating of photosensitive material is applied to the substrate, which may comprise a charge generation layer and a charge transport layer, or their blended in a single layer, to form a full photoreceptor device.

Current drum photoreceptor may be commonly comprised of a rigid aluminum substrate having specific dimensions required for straightness, roundness and counter bore concentricity. For example, the wall needs to be minimized for efficient raw material cost but also thick enough to meet the one time machining requirements and physical requirements of the finished photoreceptor device. A defect-free surface with maximum reflectivity is provided by diamond machining to a mirror finish followed by glass bead honing. A maximum surface roughness is also specified. Preparation of the aluminum substrate surface is important in maintaining uniform, defect-free print quality. Minimizing the reflectivity of the surface, eliminates a defect causes by surface reflections that has the appearance of a plywood patterns in half tone areas of prints. Exceeding the maximum surface roughness leads to charge injection and high background.

The final product generally comprises three organic coatings, an undercoat layer (UCL), that functions as a primer, a charge generation and a charge transport, and in some cases, an anti-reflective coating and a hole blocking layer may also be included and applied directly over the substrate. The final assembly of the photoreceptor has two end caps (or flanges). One end cap comprises a drive gear and the other end cap comprises of a bearing and ground strap that has a spring contact to the bearing shaft and a friction contact to the inner substrate surface. The end caps are held in place with an epoxy adhesive and must meet a specified torque and push out force after a specified thermal cycle test condition.

The fabricated photoreceptor devices are expected to have good electrical and mechanical performance in a copier or printer. But, due to complexity of the manufacturing process, it is unavoidable to have varieties of defects in some photoreceptor devices which may meet the quality requirements for the copier or printer. The defective devices have to be rejected. In another aspect, each photoreceptive device has limited application life. Once the photoreceptor device cannot function well in the machine, it is also the end of the application life of the device. These used photoreceptor devices were usually disposed in the same way as the defective devices were treated. Disposal of the device could be very costly and could cause lots of environmental issues.

Remanufacturing such a photoreceptor device is difficult because the device dimensions are very specific and minor changes can adversely impact the results. For example, there is a specific balance between the substrate surface reflectance and surface roughness that must be maintained. Moreover, such photoreceptors have wall thicknesses that are too thin to re-machine, the coating layers comprise polymers that are chemically resistant to all but the most aggressive, and often non-environmentally friendly, solvents.

Currently used coating processes are only capable of coating aluminum substrates without flanges. In the case of end of line manufacturing rejects (5 to 15%), most rejected photoreceptors are coating rejects and are not flanged. However, field returns require flange removal before remanufacturing so that re-coating can be facilitated by the existing manufacturing process and also to ensure that the flanges would not be too worn out to meet the dimensional requirements of a new or re-manufactured photoreceptor. Flange removal without causing substrate deformation is necessary, but with complete adhesive residue removal, it is also important for maintaining the overall straightness, roundness and concentricity of the final re-manufactured assembly but difficult to achieve with the presently used processes.

Thus, there exists a need for methods to recycle or reclaim electrophotographic photoreceptor devices that would address the above-identified problems. Furthermore, there is a need to reduce the cost of remanufacturing electrophotographic photoreceptors, for example, by recycling the non-usable photoreceptor devices, through removing the photosensitive or coating layers without damaging the substrate formation. This would not only reduce the cost of producing the photoreceptor, but also decreases the cost for disposing all related materials in the devices.

Conventional photoreceptors and their materials are disclosed in Katayama et al., U.S. Pat. No. 5,489,496; Yashiki, U.S. Pat. No. 4,579,801; Yashiki, U.S. Pat. No. 4,518,669; Seki et al., U.S. Pat. No. 4,775,605; Kawahara, U.S. Pat. No. 5,656,407; Markovics et al., U.S. Pat. No. 5,641,599; Monbatiu et al., U.S. Pat. No. 5,344,734; Terrell et al., U.S. Pat. No. 5,721,080; and Yoshihara, U.S. Pat. No. 5,017,449, which are herein all incorporated by reference.

More recent photoreceptors are disclosed in Fuller et al., U.S. Pat. No. 6,200,716; Maty et al., U.S. Pat. No. 6,180,309; and Dinh et al., U.S. Pat. No. 6,207,334, which are all herein incorporated by reference.

The terms used to describe the imaging members, their layers and respective compositions, may each be used interchangeably with alternative phrases known to those of skill in the art. The terms used herein are intended to cover all such alternative phrases.

SUMMARY

According to aspects illustrated herein, there is provided methods of.

In one embodiment, a method for reclaiming a substrate of a photoreceptor comprising soaking the photoreceptor in a liquid bath at room temperature, the photoreceptor comprising a substrate, a gelatin release layer disposed on the substrate, and one or more coating layers disposed on the gelatin release layer, increasing a temperature of the liquid bath to dissolve the gelatin release layer; and separating the one or more coating layers from the substrate.

In another embodiment, a method for reclaiming a rigid substrate of a photoreceptor comprising soaking the photoreceptor in a liquid bath at room temperature, the photoreceptor comprising a substrate, a gelatin release layer disposed on the substrate, and one or more coating layers disposed on the gelatin release layer, increasing a temperature of the liquid bath to dissolve the gelatin release layer, separating the one or more coating layers from the substrate, filtering the removed one or more coating layers from the liquid bath, isolating a charge transport layer from the one or more coating layers, wherein the charge transport layer comprises N,N'-diphenyl-N,N'bis(3-methylphenyl)-[1,1'-biphenyl]-4,4'diamine, drying the isolated charge transport layer, and collecting the N,N'-diphenyl-N,N'bis(3-methylphenyl)-[1,1'-biphenyl]-4,4'diamine through solvent extraction. In the present embodiments, the method for reclaiming the rigid substrate of a photoreceptor involves use of an environmentally-friendly liquid bath such as one comprising water. Using such an environmentally-friendly liquid for dissolving the gelatin release layer provides an advantage over the acid or organic solvents conventionally used.

In yet another embodiment, a photoreceptor comprising a rigid substrate, a gelatin release layer disposed on the substrate, and one or more coating layers disposed on the gelatin release layer, wherein the gelatin comprises a bio-polymer.

BRIEF DESCRIPTION OF THE DRAWINGS

For a better understanding, reference may be had to the accompanying figure.

Unless otherwise noted, the same reference numeral in different Figures refers to the same or similar feature.

DETAILED DESCRIPTION

Figure 1:
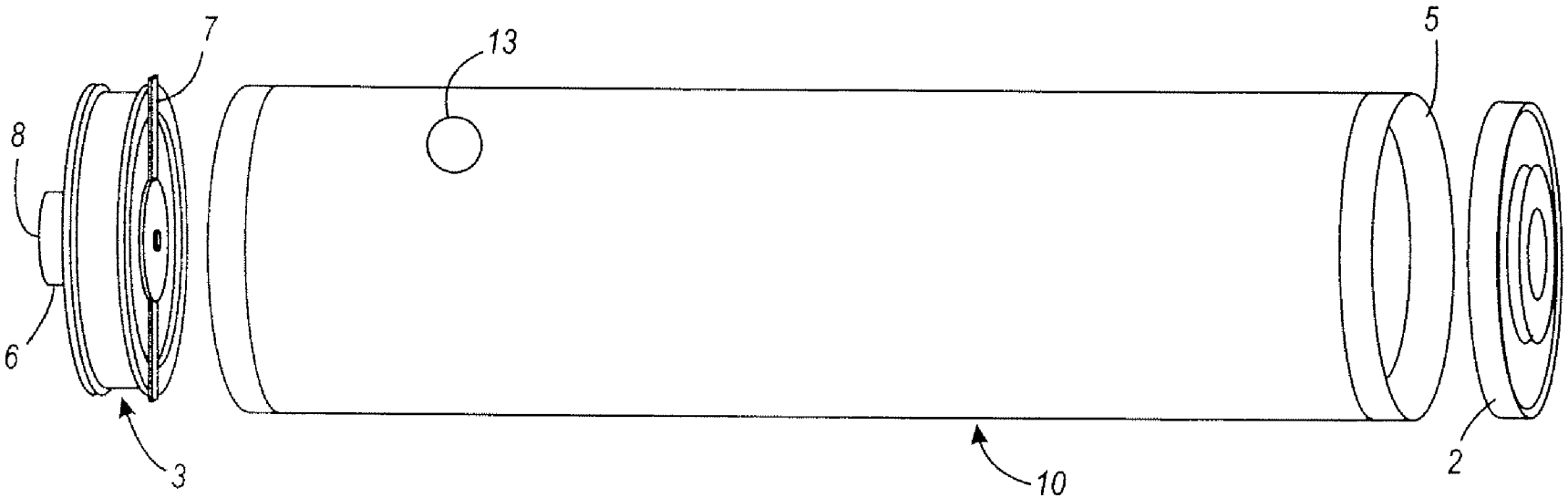
FIG. 1 is an illustration of a drum electrophotographic photoreceptor in accordance with the present embodiments.

In the following description, reference is made to the accompanying drawings, which form a part hereof and which illustrate several embodiments. It is understood that other embodiments may be utilized and structural and operational changes may be made without departure from the scope of the present disclosure. The same reference numerals are used to identify the same structure in different figures unless specified otherwise. The structures in the figures are not drawn according to their relative proportions and the drawings should not be interpreted as limiting the disclosure in size, relative size, or location.

FIG. 1 is an illustration of an electrophotographic photoreceptor showing the construction of the photoreceptor drum and various key layers. As shown in FIG. 1, the electrophotographic photoreceptor includes a rigid substrate in the shape of a cylindrical photoreceptor drum 10, and flanges 2 and 3 fitted to the opening at each end of the photoreceptor drum 10. Outboard flange 2 and inboard flange 3 are mounted at the ends of the cylindrical counter bore 5 using an epoxy adhesive. Inboard flange 3 consists of a bearing 6, ground strap 7 and drive gear 8. In some designs, either flange could containing the ground strap, the drive gear and the bearing or the function can be split between the two flanges in any combination that has a spring contact to the bearing shaft and a friction contact to the inner substrate surface. The coating layers 13 of a typical negatively charged photoreceptor design are shown in more detail in FIG. 2.

Figure 2:
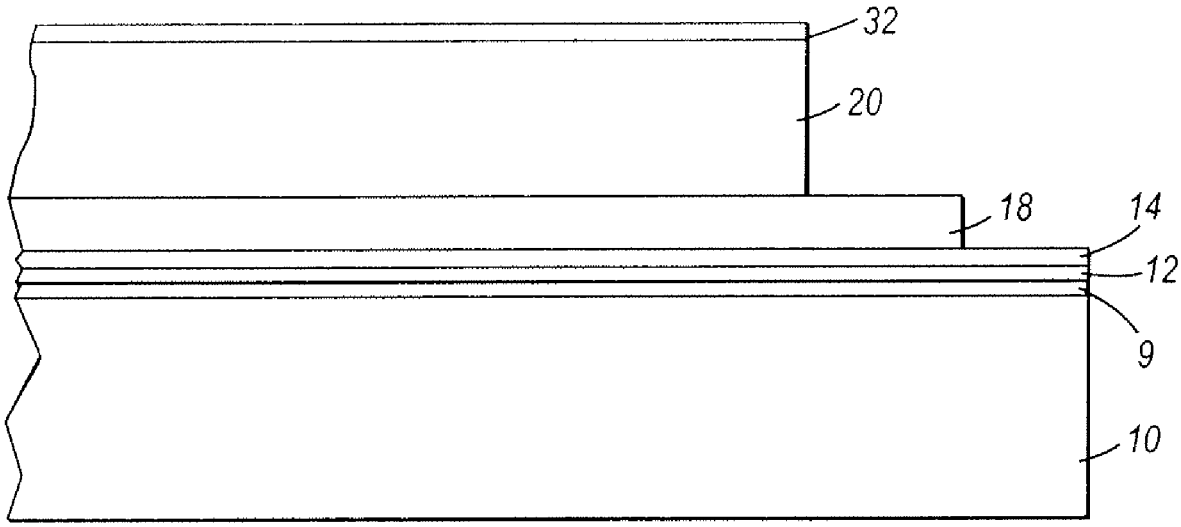
FIG. 2 illustrates a drum electrophotographic photoreceptor showing various layers in accordance with the present embodiments.

The key layers in the present disclosure embodiments, illustrated in FIG. 2, include a gelatin release layer 9 disposed directly on the substrate drum 10, an undercoat layer 14 disposed on the gelatin release layer 9, and one or more electrophotographically active imaging layers 18, 20 subsequently disposed on the undercoat layer 14. The imaging layers include a charge generation layer 18 and a charge transport layer 20. As can be seen, the imaging member layers further include a non conductive or electrically insulative rigid support substrate 10, an electrically conductive ground plane 12, and an overcoat layer 32, in addition to all the coating layers 13. However, if the substrate support 10 is by itself an electrically conductive drum 10, the application of conductive ground plane 12 is then omitted. The conductive rigid substrate 10 may be comprised of a material selected from the group consisting of a metal, metal alloy, aluminum, zirconium, niobium, tantalum, vanadium, hafnium, titanium, nickel, stainless steel, chromium, tungsten, molybdenum, and mixtures thereof. The charge generation layer 18 and the charge transport layer 20, providing the electrophotographic imaging function, are described here as two separate layers. In a positively charged photoreceptor design, alternative to what is shown in the figure, the charge generation layer may also be disposed on top of the charge transport layer. Other layers of either photoreceptor design may include, for example, an optional over coat layer 32. Overcoat layers are commonly included to increase mechanical wear and scratch resistance to prolong the service life of photoreceptor device. It will be appreciated that the functional components of these layers may alternatively be combined into a single layer.

The Substrate

An electrically conducting rigid substrate 10 may be any metal, for example, aluminum, nickel, steel, copper, and the like; or a polymeric material which is filled with an electrically conducting substance, such as carbon, metallic powder, and the like, or an organic electrically conducting material. In certain embodiments, the substrate is made from aluminum or an aluminum alloy.

The electrically insulating or conductive substrate 10 may have variances of configurations which may be in the form of an endless flexible belt, a web, a rigid cylinder, a sheet and the like. The thickness of the substrate layer depends on numerous factors, including strength desired and economical considerations. Thus, the rigid substrate 10 for a drum or a sheet, this layer may be of substantial thickness of, for example, up to many centimeters or, of a minimum thickness of less than a millimeter. By comparison, a flexible belt may substantially be of less thickness, for example, about 250 microns, or of minimum thickness less than 50 microns, provided there are no adverse effects on the final electrophotographic device. The wall thickness of the rigid drum substrate 10 is manufactured to be at least about 0.25 mm to fulfill the physical, dimensional, and mechanical requirements of the photoreceptor device. In one embodiment, the thickness of the rigid substrate is from about 0.25 mm to about 5 mm. In one embodiment, the thickness of the substrate is from about 0.5 mm to about 3 mm. In another embodiment, the thickness of the substrate is from about 0.9 mm to about 1.1 mm. However, the thickness of the substrate can also be outside of these ranges.

The surface of the rigid substrate 10 is polished to a mirror-like finish by a suitable process such as diamond turning, metallurgical polishing, and the like. The rigid substrate may alternatively have a roughening/texturing surface created through a glass bead honing process, or a combination of diamond turning followed by metallurgical polishing or glass bead honing to suppress light reflection from the substrate surface. Minimizing the reflectivity of the surface may eliminate defects caused by surface reflections that have the appearance of a plywood patterns in half tone areas of prints. Exceeding certain surface roughness, for example, 5 microns, may lead to undesirable and non-uniform electrical properties across the device, which cause poor imaging quality. In certain embodiments, the surface roughness of the substrate is controlled to be less than 1 microns, or less than 0.5 microns.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

The Release Layer

In the present embodiments of this disclosure, there is provided a gelatin release layer 9 disposed on the rigid substrate 10. The gelatin release layer is positioned between the substrate and the other coating layers and may have a thickness of less than 2.0 microns, a thickness of from about 0.2 micron to about 2.0 microns, or in further embodiments, a thickness of from about 0.2 micron to about 1.5 microns.

The use of a gelatin release layer for present disclosure application is based on the following facts:

(1) the gelatin release layer is by itself an inherent charge blocking layer having the capability to prevent hole inject from the conductive ground plane or the conductive substrate during photoreceptor electrophotographic imaging/printing processes;

(2) the gelatin release layer is readily soluble in at least 55° C. hot water, from which an aqueous solution can be easily be prepared and then applied onto the rigid substrate, and dried at elevated temperature to form the gelatin release layer of this disclosure; and (3) the gelatin release layer provides an environmentally friendly substrate recovery approach—the gelatin is very soluble in at least 55° C. hot water, thus providing easy separation and removal for stripping off all the photoreceptor coating layers from a used or rejected drum photoreceptor to effect substrate recovery by simply soaking in hot water without using toxic organic solvent(s) or nitric acid.

The gelatin release layer does therefore provide a method for reclaiming or recycling manufacturing coating rejects as well as for re-manufacturing of the photoreceptors returned from the field. The gelatin release layer allows recovery of the substrate for use in re-fabrication of photoreceptors and significantly reduces photoreceptor production cost.

In embodiments, the gelatin release layer is bio-polymer directly extracted from animal skin or bone, so it is a biopolymer. Bio-polymers are a class of polymers produced by living organisms. Biopolymers are comprised of repetitive units of amino acid residues, therefore the bio-polymer has the general structure as shown below:

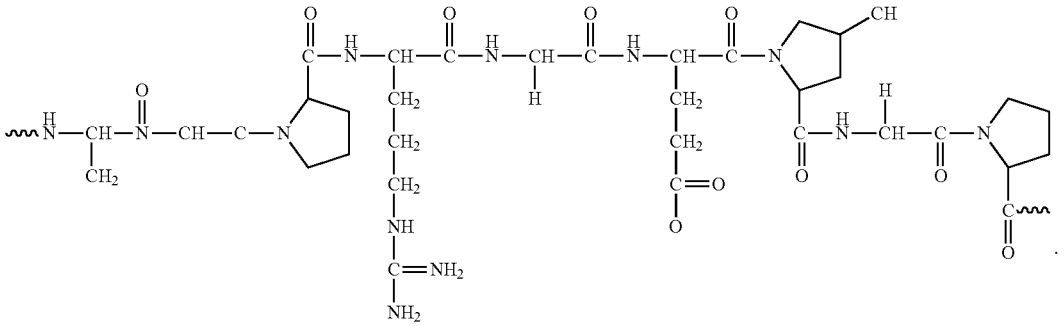

In embodiments, the bio-polymer is present in the release layer 9 in an amount of 100 percent by weight of the total weight of the release layer.

In embodiments, the substrate and counter bore is first coated with a very thin gelatin inner layer by dipping the substrate into a hot dilute aqueous gelatin solution prior to applying the coating layers of the photoreceptor. In embodiments, the hot solution has a temperature of from about 55° C. to about 95° C., or from about 60° C. to about 90° C., or from about 70° C. to about 80° C. In specific embodiments, the hot solution has a temperature of about 80° C. Both the inner and outer surfaces of the substrate are coated before final end cap assembly. The thin pre-coated gelatin release layer is obtained after drying and provides good adhesion to the substrate, good bonding to the ground plane, the UCL layer or adhesive layer and good bonding to the end caps. Moreover, the gelatin release layer will be soluble in hot water which provides easy substrate recovery processing.

Thus, the present embodiments provide for an improved method of removal of all the photoreceptor coating layers and flanges from the counter bore for efficient substrate recovery without substrate damage. Use of the gelatin release layer in the present methods facilitates a stripping process that does not alter the surface characteristics of the substrate or the dimensional integrity of the reclaimed substrate. In addition, the method of present disclosure uses environmentally friendly solvents and not the toxic solvents generally required for stripping the photoreceptor coating layers.

In embodiments, the end caps (or flanges) and coating layers are released and removed from the substrate by immersing and soaking the entire photoreceptor in water bath at room temperature for less than about 24 hours to allow water penetration. In other embodiments, the photoreceptor is soaked in the water bath from about 9 hours to about less than 24 hours, from about 9 hours to about 16 hours. In further embodiments, the photoreceptor is soaked in the water bath overnight for about 16 hours, or for about 9 hours. The temperature of the water bath, after the hours of photoreceptor immersing, is then elevated temperature to dissolve the gelatin release layer. In embodiments, the water bath temperature, after photoreceptor soaking, is then elevated from room ambient to from about 55° C. to about 95° C., or elevated to from about 60° C. to about 90° C., or elevated to from about 70° C. to about 80° C. Following the water bath soak, the plurality of coating layers from the drum substrate may be separated by peeling the plurality of coating layers off or by scraping the plurality of coating layers away. If the flanges are present, the flanges can be separated from the substrate by peeling, scraping and removing actions can be performed by hand or using a tool such as a razor, doctor blade, skive, brushes, scrubbing pads. The flanges can be removed by applying torque and pull force to grippers or by impact using a bar or rod inserted in one end. The coating layers may be degraded partially or completely.

The effectiveness of the effective gelatin layer to release photoreceptor coatings has also been experimentally evaluated. Experimental studies conducted with a model photoreceptor device prepared on a flat substrate sheet demonstrated that the gelatin release layer is able to provide spontaneous and total removal of all the coating layers by soaking the sheet photoreceptor in 90° C. water.

The recovered substrate can subsequently be used for remanufacturing. As substrates, such as aluminum substrates, represent about 50 percent of photoreceptor raw materials cost in the manufacture of organic photoreceptors, the present embodiments facilitate a significant cost savings.

The method also provides an added advantage of recovering valuable photoreceptor materials, such as N,N'-diphenyl-N,N'bis(3-methylphenyl)-[1,1'-biphenyl]-4,4'diamine (m-TBD), as well as provides a gelatin release layer with inherent hole blocking property. After removal of the photoreceptor coating layers, the insoluble coating layers may be separated from the water by filtration. Next, the filtered charge transport layer is dried and the m-TBD in the charge transport layer can be obtained through solvent extraction.

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion. In embodiments, the overcoat layer 32 may have a thickness ranging from about 0.1 micron to about 10 microns or from about 1 micron to about 10 microns, or in a specific embodiment, about 3 microns. These overcoating layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including aluminum oxide, non-metal oxides including silica or low surface energy polytetrafluoroethylene (PTFE), and combinations thereof. Suitable resins include those described above as suitable for photogenerating layers and/or charge transport layers, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoating layers may be continuous and have a thickness of at least about 0.5 micron, or no more than 10 microns, and in further embodiments have a thickness of at least about 2 microns, or no more than 6 microns.

The Ground Plane

In the event that an electrically insulative or non conductive substrate 10 is utilized, an electrically active ground plane 12 is needed and applied over the substrate. The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl)methyl diethoxysilane, as disclosed in U.S. Pat. Nos. 4,338,387, 4,286,033 and 4,291,110.

General embodiments of the undercoat layer may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer should be continuous and may have a thickness of from about 1 micron to about 23 microns. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Adhesive Layer

An optional separate adhesive interface layer (not shown in FIG. 2), if needed, may be provided in certain configurations, such as for example, in flexible web configurations. In the embodiment illustrated in FIG. 2, the interface layer would be situated between the blocking layer 14 and the charge generation layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer may have a thickness of at least about 0.01 microns, or no more than about 900 microns after drying. In embodiments, the dried thickness is from about 0.03 microns to about 1 micron.

The Charge Generation Layer

The charge generation layer 18 may thereafter be applied to the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

A number of titanyl phthalocyanines, or oxytitanium phthalocyanines for the photoconductors illustrated herein are photogenerating pigments known to absorb near infrared light around 800 nanometers, and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the disclosures of which are totally incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the disclosure of which is totally incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of less than 1 μm, or about 0.25 μm. These embodiments may be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

The Charge Transport Layer

In a drum photoreceptor, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The layer 20 is normally transparent in a wavelength region in which the electrophotographic imaging member is to be used when exposure is affected there to ensure that most of the incident radiation is utilized by the underlying charge generation layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 15 microns to about 40 microns, and more specifically, of a thickness of from about 15 microns to about 35 microns. Examples of charge transport components are aryl amines of the following formulas/structures:

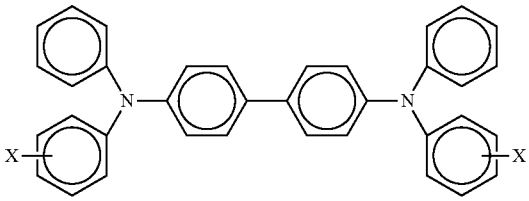

and

-continued

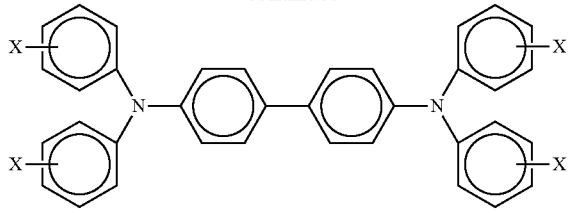

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

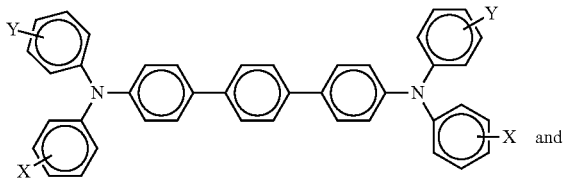

and

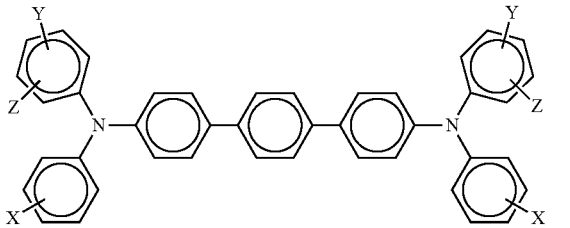

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other drum coating methods may be used.

Drying of the deposited coating may be effected by any suitable conventional technique such as oven drying, infra red radiation drying, air drying and the like. The thickness of the charge transport layer after drying is from about 10 μm to about 40 μm or from about 12 μm to about 36 μm for optimum photoelectrical and mechanical results. In another embodiment the thickness is from about 14 μm to about 36 μm.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method for reclaiming a substrate of a photoreceptor comprising:

soaking the photoreceptor in a liquid bath at room temperature, the photoreceptor comprising an electrically conductive rigid substrate, a gelatin release layer disposed on the substrate, an undercoat layer disposed on the gelatin release layer, wherein the gelatin comprises a bio-polymer; and a charge generation layer disposed on the undercoat layer;

increasing a temperature of the liquid bath to dissolve the gelatin release layer; and separating the one or more coating layers from the substrate.

2. The method of claim 1, wherein the bio-polymer comprises repetitive units of amino acid residues and has the structure as shown below:

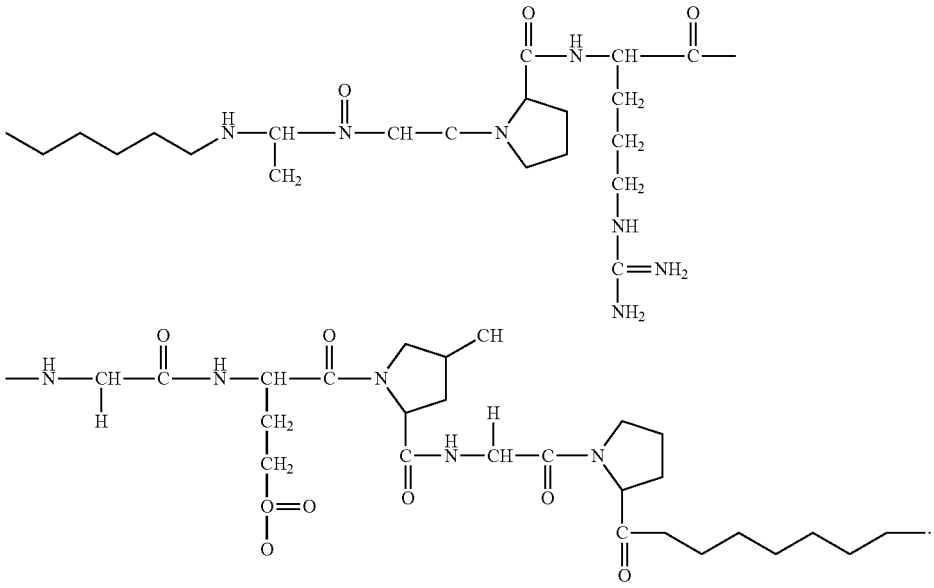

3. The method of claim 1, wherein the gelatin release layer comprises 100 percent by weight of the gelatin by the total weight of the release layer.

4. The method of claim 1, wherein the photoreceptor further comprises flanges connected to either end of the photoreceptor substrate and separating step includes separating the flanges from the substrate.

5. The method of claim 1, wherein the separating step includes peeling or scraping off the one or more coating layers.

6. The method of claim 1, wherein the liquid bath comprises water.

7. The method of claim 6, wherein the photoreceptor is soaked in the liquid bath for not more than about 24 hours.

8. The method of claim 7, wherein the photoreceptor is soaked in the liquid bath for about 16 hours.

9. The method of claim 1, wherein the temperature of the liquid bath is elevated from room temperature to from about 55° C. to about 95° C.

10. The method of claim 1, wherein the temperature of the liquid bath is elevated from room temperature to from about 70° C. to about 80° C.

11. The method of claim 1, wherein the gelatin release layer has a thickness of less than 2.0 microns.

12. The method of claim 11, wherein the gelatin release layer has a thickness of from about 0.2 micron to about 1.5 microns.

13. A method for reclaiming a rigid substrate of a photoreceptor comprising:

soaking the photoreceptor in a liquid bath at room temperature, the photoreceptor comprising an electrically conductive rigid substrate, a gelatin release layer disposed on the substrate, an undercoat layer disposed on the gelatin release layer, wherein the gelatin comprises a bio-polymer; and a charge generation layer disposed on the undercoat layer;

increasing a temperature of the liquid bath to dissolve the gelatin release layer;

separating the one or more coating layers from the electrically conductive rigid substrate;

filtering the removed one or more coating layers from the liquid bath;

isolating a charge transport layer from the one or more coating layers, wherein the charge transport layer comprises N,N'-diphenyl-N,N'bis(3-methylphenyl)-[1,1'-biphenyl]-4,4'diamine;

drying the isolated charge transport layer; and collecting the N,N'-diphenyl-N,N'bis(3-methylphenyl)-[1,1'-biphenyl]-4,4'diamine through solvent extraction.

14. The method of claim 13, wherein the bio-polymer comprises repetitive units of amino acid residues and has the structure as shown below:

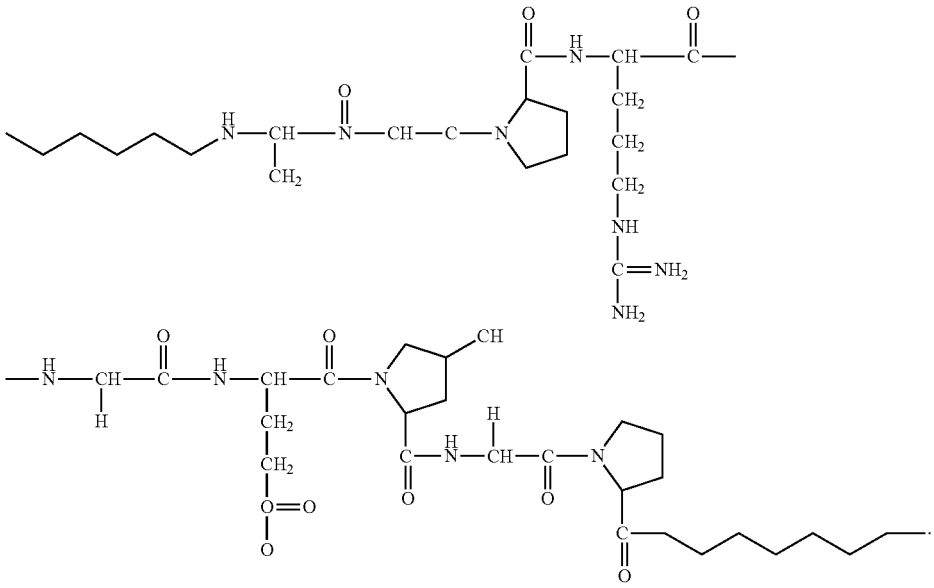

15. The method of claim 13, wherein the gelatin release layer comprises 100 percent by weight of the gelatin by the total weight of the release layer.

16. A photoreceptor comprising an electrically conductive rigid substrate, a gelatin release layer disposed on the substrate, and an undercoat layer disposed on the gelatin release layer, wherein the gelatin comprises a bio-polymer; and a charge generation layer disposed on the undercoat layer.

17. The photoreceptor of claim 16, wherein the rigid substrate is aluminum.

18. The photoreceptor of claim 16, wherein the bio-polymer comprises repetitive units of amino acid residues and has the structure as shown below:

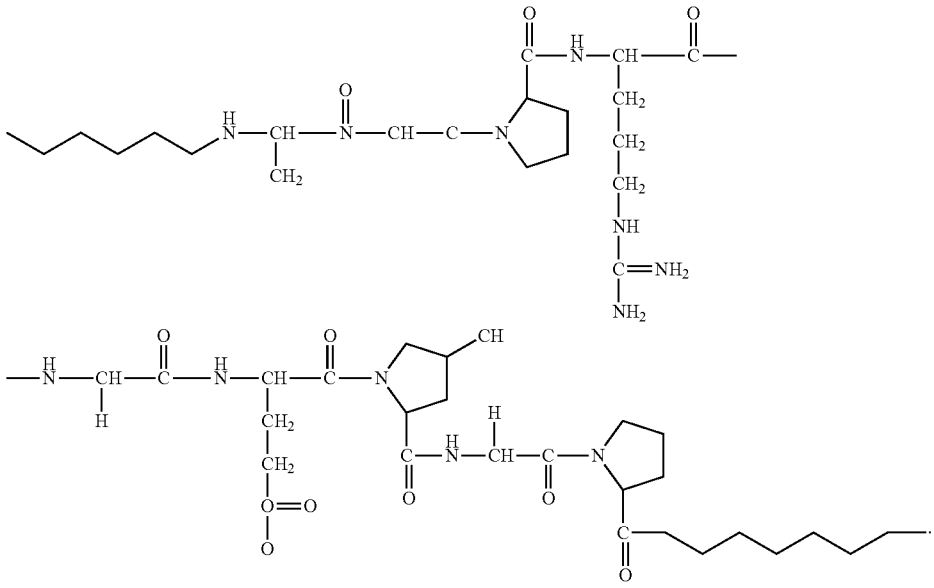

19. The photoreceptor of claim 16, wherein the gelatin release layer comprises 100 percent by weight of the gelatin by the total weight of the release layer.

20. The photoreceptor claim 16, wherein the gelatin release layer has a thickness of less than 2.0 microns.

* * * * *